United States Patent [19]

Cagle

[11] 4,048,876

[45] Sept. 20, 1977

[54] ADJUSTABLE OPEN END WRENCH

[76] Inventor: William A. Cagle, 2414 Decotts Ave., Sanford, Fla. 32771

[21] Appl. No.: 732,422

[22] Filed: Oct. 14, 1976

[51] Int. Cl.[2] ..... B25B 13/16
[52] U.S. Cl. ..... 81/165; 81/170
[58] Field of Search ..... 81/155, 165, 170, 171

[56] References Cited

U.S. PATENT DOCUMENTS

| | | | |
|---|---|---|---|
| 2,913,942 | 11/1959 | Rozmus | 81/165 |
| 2,955,498 | 10/1960 | Engstrand | 81/165 |

*Primary Examiner*—Al Lawrence Smith
*Assistant Examiner*—James G. Smith
*Attorney, Agent, or Firm*—Duckworth, Hobby, Orman, Allen & Pettis

[57] ABSTRACT

This invention relates to an improvement for an adjustable open end wrench of the type comprising a stationary jaw and a movable jaw having a rack gear coupled thereto. A helical gear is coupled between the rack gear and the stationary jaw for driving the movable jaw toward and away from the stationary jaw. The rotational axis of the helical gear is oriented at an acute angle with respect to the longitudinal axis of the rack gear and the direction of motion of the movable jaw. This acute angle is substantially equal to the pitch axis of the helical gear teeth, whereby tangential sections of the helical gear teeth which are in sliding communication with the rack gear teeth are substantially perpendicular to the direction of motion of the movable jaw.

13 Claims, 5 Drawing Figures

ADJUSTABLE OPEN END WRENCH

BACKGROUND OF THE INVENTION

I. Field of the Invention

This invention relates to adjustable open end wrenches, and in particular to an improvement for preventing the slippage of the movable jaw of the wrench responsive to pressure exerted thereupon.

II. Description of the Prior Art

The adjustable open end wrench or the crescent wrench, of the type disclosed by Peterson in U.S. Pat. No. 1,133,236 has become widely used in all mechanical areas due to the easily adjustable span of the open end of the wrench. However, at the same time the design of the wrench has become notorious as a "knuckle buster" since in the simplest form of the wrench the worm gear is free to rotate as pressure is exerted upon the movable jaw.

Various inventors have attempted to solve this problem primarily by providing a locking mechanism to secure the rotation of the worm gear after the span between the movable and fixed jaw has been established. Bush, in U.S. Pat. No. 1,160,494 discloses the use of an arm which extends into contact with the teeth of the worm gear for restricting the rotational movement thereof. Anderson in U.S. Pat. No. 1,490,903 discloses the use of a pivoted handle which engages the flat end surface of the worm gear for locking it into place. Pugh in U.S. Pat. No. 2,687,662 discloses the use of a manually operable pin in threaded engagement with the worm gear for locking the worn gear after the span has been adjusted. Jackson in U.S. Pat. No. 2,688,893discloses a spring actuated lever which engages longitudinally arranged parallel grooves within the threads of the worm gear for restricting the movement thereof. Brynge in U.S. Pat. No. 2,691,897 discloses a specially designed tooth profile for use on the worm and the rack gears for eliminating the slippage therebetween. Brynge in U.S. Pat. No. 2,709,387 discloses the use of springs resiliently mounted adjacent the end of the worm gear pin for holding the adjustment screw in engagement with the teeth of the movable jaw.

Each of these modifications to the basic adjustable open end wrench design requires further elements which must be produced and assembled with the wrench. After long periods of use these elements may become worn or jammed, thus causing the wrench to be unusable. Generally the wrench is discarded in favor of a wrench of a more straightforward design with fewer problem features. In contrast with the prior art, the present invention utilizes essentially the same elements as the prior art, but these elements have been redesigned and repositioned to cooperate differently so as to produce an adjustable open end wrench which is unexpectedly easy to operate, inexpensive to produce and generally free of slippage problems which have plagued the prior art wrenches.

SUMMARY OF THE INVENTION

This invention relates to an adjustable open end wrench comprising a stationary jaw attached to a head section of the adjustable open end wrench. A movable jaw is slidably mounted on the stationary jaw for moving toward and away from the stationary jaw for defining a plane of motion therebetween. A rack gear is coupled to the movable jaw for being engaged by a helical gear mounted adjacent thereto. The helical gear includes thereon helical gear teeth of a known pitch angle for engaging the teeth of the rack gear for driving the movable jaw along the plane of motion. The helical gear is rotatable about an axis of rotation which is oriented generally at a small acute angle with respect to the plane of motion. This small acute angle is substantially equal to the pitch angle of the worm gear, whereby the tangential sections of the worm gear which are in sliding communication with the rack gear teeth are substantially perpendicular to the plane of motion of the movable jaw.

BRIEF DESCRIPTION OF THE DRAWINGS

Other objects, features and advantages of the presnt invention will become apparent from a study of the written description and the drawings in which.

DETAILED DESCRIPTION OF THE PREFERRED EMBODIMENT

Figure 1:
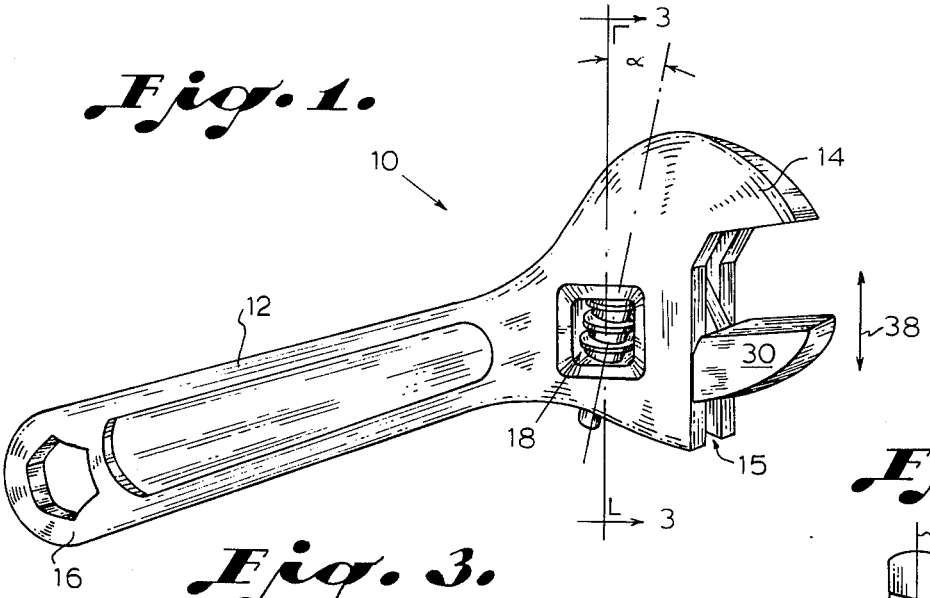
FIG. 1 illustrates a frontal perspective view of an adjustable open end wrench in accordance with the present invention.

A first preferred embodiment in accordance with the present invention is shown generally as 10 in FIG. 1. The adjustable open end wrench 10 comprises an elongated handle section 12 coupled at one end thereof to a head section 14 and having at a distended end thereof a multisided aperture 16 therethrough in the form of a hex box end wrench which may also be used for hanging the adjustable open end wrench for storage. The head section 14 includes a stationary jaw 20 integrally formed therewith and a gear aperture 18 communicating transversely through a central section of the head 14.

Figure 3:
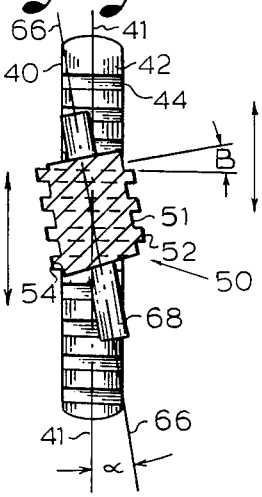
PRIOR ART Fig. 3.
FIG. 3 is a cross-section view taken along section lines 3—3 in FIG. 1 illustrating the angular offset of the worm gear as compared to the longitudinal axis of the rack gear.
Figure 4:
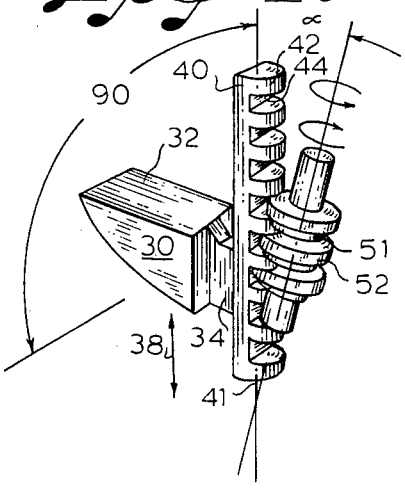
FIG. 4 is a perspective illustration of the operation of the worm gear as it engages the rack gear.
Figure 5:
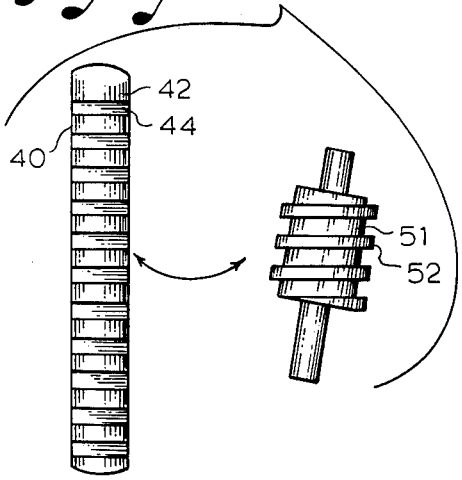
FIG. 5 illustrates the worm and rack gears of FIG. 3 unfolded from each other to reveal the communicating surfaces thereof.

With reference to FIGS. 1 and 4, the movable jaw 30 includes a face section 32 thereon coupled by a brace guide 34 to a rack gear section 40. The brace guide 34 of the movable jaw 32 communicates through a jaw slot 15 within the head 14. The rack gear 40 communicates within a vertically aligned bore (not shown) within the head section 14 of the adjustable open end wrench 10. As illustrated in FIGS. 3 and 4, the rack gear 40 includes a plurality of generally evenly spaced gear teeth 42 which define therebetween a gear recess 44. The gear teeth 42 have substantially planar surfaces thereon, with the effective communicating surface of the gear teeth 42 being substantially perpendicular to a longitudinal axis 41 of the rack gear 40. The separation between the gear teeth 42 is predetermined to couple with the pitch angle of a helical or worm gear shown generally as 50.

As illustrated in FIGS. 1 and 3, the worm gear 50 is rotatably restrained within the gear aperture 18 by a worm gear pin 68 communicating generally coaxially through the worm gear 50. The distended ends of the worm gear pin 68 are restrained within congruent coupling sections (not shown) within the head 14 of the adjustable open end wrench 10. The worm gear 50 comprises a generally cylindrical body section 51 having a plurality of raised worm gear teeth 52 spiraled there around. The pitch angle of the worm gear 52 and the lead of the worm gear teeth 52 are determined for operatively coupling with the gear teeth 42 of the rack gear 40 for driving the movable jaw 30 in a direction toward or away from the stationary jaw 20. As used herein the term pitch angle indicates that acute angle included between one face of the worm gear tooth 52 and a perpendicular to a rotational axis 66 of the worm gear pin 68 and the worm gear 50. The pitch angle is illustrated generally as $\beta$ (beta) in FIG. 3.

With continuing reference to FIG. 3, the rotational axis 66 of the worm gear 50 and the worm gear pin 68 is canted at an angle $\alpha$ (alpha) with respect to a longitudinal axis 41 of the rack gear 40. Since the longitudinal axis 41 of the rack gear 40 is generally parallel with and contained in the plane of motion defined by the movable jaw 30 moving toward and away from the stationary jaw 20, it follows that the rotational axis 66 of the worm gear 50 is also canted or oriented at the acute angle alpha with respect to the plane of motion 38 of the movable jaw 30. With this geometry, the circumferential section of the worm gear tooth 52, which is impressed within the gear recess 44 between the gear teeth 42 of the rack gear 40, is generally perpendicular to the longitudinal axis 41 of the rack gear 40. Since the gear teeth 42 of the rack gear 40 are substantially perpendicular to the longitudinal axis 41 thereof, the worm gear teeth 52 are in sliding coplanar communication with the gear teeth 42 of the rack gear 40 as the worm gear 50 is rotated to move the rack gear 40, having the movable jaw 30 coupled thereto, along the longitudinal axis 41 thereof.

Figure 2:
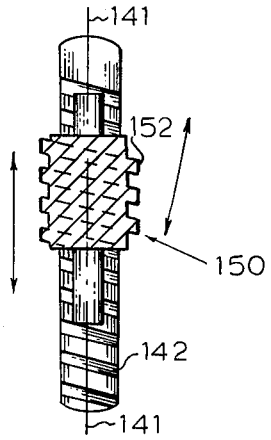
FIG. 2 illustrates a cross-section view of the worm gear and rack gear as disclosed by the prior art.

The geometry of the present invention as illustrated in FIG. 3 is to be contrasted with the prior art geometry as shown in FIG. 2. Under the prior art, the rotational axis 166 of the worm gear 150 is oriented generally parallel to the longitudinal axis 41 of the rack gear 140. Therefore, the communicating circumferential surfaces of the worm gear teeth 152 and the rack gear teeth 142 will be canted or angled with respect to the rotational axis 166 by an angle equivalent to the pitch angle of the worm gear teeth 152. Thus, as a force is exerted upon the movable jaw 30 of a prior art wrench, the torque exerted by the rack gear teeth 142 upon the worm gear teeth 152 will tend to produce a rotation of the worm gear 150 about its rotational axis 166 in a manner equivalent to a wedge being expelled from beneath a heavy object resting upon the angled surface of the wedge. In other words, the mechanical advantage of the pitch angle of the worm gear 150 which has its rotational axis 166 parallel to the longitudinal axis 141 of the rack gear 140 also may cause a small rotation of the worm gear 150 about its rotational axis 166. The only force preventing this rotation will be the frictional communication between the worm gear teeth 152 and the rack gear teeth 142. This slippage allows the jaws to separate causing the jaws to slip on the nut or bolt.

This is to be contrasted with the present invention in which the communicating circumferential surface of the worm gear teeth 52 is generally perpendicular to the direction of motion and the longitudinal axis of the rack gear 40. In practice, this geometry greatly reduces if not generally eliminating the tendency of the movable jaw 30 to further separate from the stationary jaw 20 as a tightening torque is exerted upon the handle section 12 of the adjustable open end wrench 10.

With continuing reference to FIGS. 1 and 3, a bottom end surface 54 of the cylindrical body section 51 of the worm gear 50 congruently couples with a lower surface within the gear aperture 18 of the head section 14 of the adjustable open end wrench 10. Likewise, an upper end surface 56 of the cylindrical body section 51 of the worm gear 50 rotatably couples with an upper planar surface within the gear aperture 18 of the adjustable open end wrench 10. This coupling provides an additional restraining force to prevent the movement of the worm gear pin 68 within its journaled receptacles (not shown).

After a study of the preceeding description it will be apparent to one skilled in the art that to obtain optimum performance from the present wrench design. The tangential section of the circumference of the worm gear tooth 52 should be both parallel with a cooperating and communicating surface of the rack gear teeth 42 and perpendicular to the longitudinal axis 41 and the direction of motion of the rack gear 40. This geometry is most easily obtained by skewing the rotational axis of the worm gear 50 with respect to the longitudinal axis 41 of the rack gear 40 by an angle equal to the pitch angle of the worm gear teeth 52. However, other mechanical variations of achieving the same geometrical relationship between the operative elements are also considered to be within the scope of the present invention. Furthermore, some degree of each of these same advantages may be obtained by canting the rotational axis of the worm gear 50 with respect to the longitudinal axis 41 of the rack gear 50 by an angle less than the pitch angle of the worm gear teeth 52, but the operational improvements will not be as great as with the preferred geometry. Also, the worm gear 50 and the rack gear 40 may be designed such that only a small tangential section of the circumference of the worm gear 50 is rotated. This geometry is also satisfactory since any small increment in the angular variation between the two generally planar surfaces represents only a second order effect in the overall operation of the adjustable open end wrench 10.

In practice, the movable jaw 30 is substantially fixed and locked as a torque is exerted upon the elongated handle section 12, without the necessity of any auxiliary locking means for preventing the rotation of the worm gear 50 about its rotational axis 66. This result is achieved by using the same materials, construction techniques and wrench designs as with the prior art wrenches, with the exception of the canting of the rotational axis 66 of the worm gear 50. It will also be understood by one skilled in the art that various pitch angles and canting angles may be substituted for the ones shown in the first preferred embodiment of the present invention to satisfy the requirements of specific uses for the wrench. However, within machining and manufacturing limits, the angular offsets and pitch angles should be related as previously discussed.

Thus, a first preferred embodiment of an adjustable open end wrench has been discussed as an example of the invention as claimed. However, the present invention should not be limited in its application to the details illustrated in the accompanying drawings of the specifications since this invention may be practiced and constructed in a variety of different embodiments. Also, it must be understood that the terminology and descriptions employed herein are used solely for the purpose of describing the general operation of the preferred embodiment and therefore should not be construed as limitations on the operability of the invention.

I Claim:

1. An adjustable open end wrench comprising in combination:

a stationary jaw attached to a head section of said adjustable open end wrench;

a movable jaw slidably mounted on said stationary jaw for moving toward and away from said stationary jaw for defining a plane of motion therebetween;

a rack gear coupled to said movable jaw; and a helical gear including thereon helical gear teeth of a known pitch angle for engaging rack gear teeth of said rack gear for driving said movable jaw along said plane of motion, with engaging tangential sections of said helical gear teeth and said rack gear teeth at the points of sliding contact being perpendicular to said plane of motion.

2. The adjustable open end wrench as described in claim 1 wherein said helical gear is rotatably coupled to said head section about an axis of rotation oriented generally at a first angle with respect to said plane of motion, with said first angle being substantially equal to said pitch angle of said helical gear teeth.

3. The adjustable open end wrench as described in claim 2 wherein said rack gear teeth are generally planar and tangentially parallel to a contacting section of said helical gear teeth.

4. The adjustable open end wrench as described in claim 3 wherein said helical gear comprises a generally cylindrical worm gear.

5. The adjustable open end wrench as described in claim 4 wherein said cylindrical worm gear is rotatably coupled within a recessed seat in said head section, with planar end sections of said recessed seat being parallel and in sliding contact with end sections of said cylindrical worm gear and oriented generally perpendicular to said axis of rotation of said helical gear.

6. The adjustable open end wrench as described in claim 5 further comprising an elongated handle attached to said head section, with a distended end of said elongated handle including a multisided aperture therein for forming a box end wrench.

7. The adjustable open end wrench as described in claim 2 wherein said helical gear is rotatably coupled to said head section about an axis of rotation canted generally at a second angle with respect to a longitudinal axis of said rack gear, with said second angle being substantially equal to said pitch angle of said helical gear teeth.

8. An improved adjustable open end wrench of the type including a worm gear with worm teeth of known pitch angle for rotatably engaging rack teeth of a rack gear, with said worm gear and said rack gear being coupled between a fixed jaw and a movable jaw for driving said movable jaw in a first plane towards said fixed jaw, wherein the improvement comprises:

orienting a central rotational axis of said worm gear at a first angle with respect to a longitudinal axis of said rack gear, with said first angle being substantially equal to said pitch angle of said worm gear teeth.

9. The adjustable open end wrench as described in claim 8 wherein a tangential section of said worm gear teeth and a tangential section of said rack gear teeth in communication therewith are generally perpendicular to said first plane of movement defined by said movable jaw.

10. The adjustable open end wrench as described in claim 8 wherein said rack gear teeth are substantially perpendicular to said longitudinal axis of said rack gear.

11. The adjustable open end wrench as described in claim 10 wherein said longitudinal axis of said rack gear is parallel to said first plane of movement defined by said movable jaw.

12. The adjustable open end wrench as described in claim 11 wherein said longitudinal axis of said rack gear is contained within said first plane of movement of said movable jaw.

13. The adjustable open end wrench as described in claim 12 wherein a planar end of said worm gear movably communicates with a planar surface of said head section which is oriented at said first angle with respect to said longitudinal axis of said rack gear.

* * * * *